US008105977B2

(12) United States Patent
Kim et al.

(10) Patent No.: US 8,105,977 B2
(45) Date of Patent: Jan. 31, 2012

(54) COUNTERFEIT PREVENTION PAPER AND MANUFACTURING METHOD THEREOF

(75) Inventors: Kuk-Hwan Kim, Daejeon (KR); Yang-Kyu Choi, Daejeon (KR); Oktay Yarimaga, Daejeon (KR); Hyun Gyu Park, Daejeon (KR); Tae Won Kim, Daejeon (KR); Yun Kyung Jung, Daejeon (KR)

(73) Assignee: Korea Advanced Institute of Science and Technology (KR)

( * ) Notice: Subject to any disclaimer, the term of this patent is extended or adjusted under 35 U.S.C. 154(b) by 793 days.

(21) Appl. No.: 12/189,074

(22) Filed: Aug. 8, 2008

(65) Prior Publication Data

US 2009/0047488 A1 Feb. 19, 2009

(51) Int. Cl.
*B41M 5/26* (2006.01)

(52) U.S. Cl. ..... 503/200; 427/152; 503/226

(58) Field of Classification Search ..... None
See application file for complete search history.

(56) References Cited

U.S. PATENT DOCUMENTS

| | | | | |
|---|---|---|---|---|
| 4,721,769 | A * | 1/1988 | Rubner | 528/75 |
| 5,085,801 | A * | 2/1992 | Thierry et al. | 252/408.1 |
| 5,627,126 | A * | 5/1997 | Amano et al. | 503/226 |
| 7,829,162 | B2 * | 11/2010 | Eskra et al. | 428/32.69 |

FOREIGN PATENT DOCUMENTS

| | | |
|---|---|---|
| JP | 10315620 | 2/1998 |
| JP | 2000141961 | 5/2000 |
| JP | 2001205938 | 7/2001 |

* cited by examiner

*Primary Examiner* — Bruce H Hess
(74) *Attorney, Agent, or Firm* — The Belles Group, P.C.

(57) ABSTRACT

The present invention relates to a counterfeit prevention paper and manufacturing method thereof, and more particularly to currency, securities, official document and several certificates, etc.

The counterfeit prevention paper according to the present invention comprises a paper and a thermopaint layer which is formed on a paper and is discolored according to a temperature.

The counterfeit prevention paper according to the present invention can detect easily a counterfeit by an unaided eye. Also, a function for preventing a counterfeit is not copied by a counterfeit device, thus the counterfeit prevent paper according to the present invention can improve a reliability of various official documents and several certificates, etc.

17 Claims, 2 Drawing Sheets

COUNTERFEIT PREVENTION PAPER AND MANUFACTURING METHOD THEREOF

This Nonprovisional application claims priority under 35 U.S.C. §119(a) on Patent Application No. 10-2007-0081090 filed in Korea on Aug. 13, 2007 the entire contents of which are hereby incorporated by reference.

BACKGROUND OF THE INVENTION

1. Field of the Invention

The present invention relates to a counterfeit prevention paper and manufacturing method thereof, and more particularly to currency, securities, official document and several certificates, etc.

2. Description of the Background Art

According as the society coming to be complicated and diversified, fraudulent practices by a forgery and a document counterfeit happening even hitherto frequently are coming to be more various. Also, currency, securities, official document and several certificates, etc. having specific counterfeit prevention device become the object of forgery crime, and it is happening more frequent than previously.

Particularly, the outflow of personal historic information due to the supply of Internet is raised lately as a serious problem. Hereby, by using the personal historic information of flow, various types of several certificates such as a resident registration transcript/abstract, an automobile registration card, etc. being used as a basic certificate of citizen economic life can be forged more easily. It uses as an instrument of the second fraud by using the forged various types of several certificates, and this crime also is happening in various types.

Accordingly, various devices and methods preventing a counterfeit of various securities and certificates in use is putting in force, and an use of a counterfeit or a forged securities is increasing according as the supply of computer scanner, color printer and color copying machine is enlarged recently. Recently, it judged whether it was forged by adapting a hidden picture for preventing a counterfeit in currency and securities and the silver line being converted into the black, etc. In this case, according to technical problem required to the process for discriminating a counterfeit, it has a problem that people discriminates easily whether it is forged substantially, Due to this problem, a counterfeit and forged securities being manufactured by devices of computer scanner, color printer, and color copier, etc. can infringe on public interests and the property right of another person.

SUMMARY OF THE INVENTION

Accordingly, an object of the present invention is to solve at least the problems and disadvantages of the background art.

It is an object of the present invention to provide a counterfeit prevent paper that a function for preventing a counterfeit of all sorts of currencies, securities, official documents, and various types of several certificates, etc. is improved, and it is easy to discriminate a counterfeit.

According to an aspect of the present invention, a counterfeit prevention paper comprises a paper; and a thermopaint layer being formed on the paper and discolored according to a temperature.

The counterfeit prevention paper further comprises an adhesion layer being formed between the paper and the thermopaint layer.

The counterfeit prevention paper further comprises a protection layer being formed on the thermopaint layer.

The thermopaint layer comprises a reversible Poly-di-acetylene layer; and an irreversible Poly-di-acetylene layer.

The reversible Poly-di-acetylene layer may be formed from Poly-vinyl Alcohol and Poly-di-acetylene, and the Poly-di-acetylene is manufactured by 10,12-pentacosadiynoicacid-2,2'-(ethylenedioxy)bis(ethylamine).

The irreversible Poly-di-acetylene layer may be formed from Poly-vinyl Alcohol and Poly-di-acetylene, and the Poly-di-acetylene is manufactured by 10,12-pentacosadiynoic acid.

The color of the reversible Poly-di-acetylene layer may be discolored reversibly at 30° C. to 80° C.

The adhesion layer may comprise one out of Polyester, Nylon and Polyimide.

The protection layer may comprise one out of colorless and transparent Polyester, Nylon and Polyimide.

The adhesion layer and the paper may be adhered by the adhesives including Polysiloxane.

According to another aspect of the present invention, a method of manufacturing a counterfeit prevention paper comprises the step of forming an adhesion layer on a paper; and forming a thermopaint layer being discolored according to a temperature on the adhesion layer.

The method of manufacturing a counterfeit prevention paper further comprises the step of forming a protection layer on the thermopaint layer.

The adhesion layer may be formed from one out of Polyester, Nylon and Polyimide.

The thermopaint layer comprises a reversible Poly-di-acetylene layer; and an irreversible Poly-di-acetylene layer.

The reversible Poly-di-acetylene layer may be formed from Poly-vinyl Alcohol and Poly-di-acetylene, and the Poly-di-acetylene is manufactured by 10,12-pentacosadiynoic acid-2,2'-(ethylenedioxy)bis(ethylamine).

The color of the reversible Poly-di-acetylene layer may be discolored reversibly at 30° C. to 80° C.

The irreversible Poly-di-acetylene layer may be formed from Poly-vinyl Alcohol and Poly-di-acetylene, and the Poly-di-acetylene is being manufactured by 10,12-pentacosadiynoic acid.

The protection layer may comprise one out of colorless and transparent Polyester, Nylon and Polyimide.

The adhesion layer and the paper may be adhered by the adhesives including Polysiloxane.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

The advantages and objects of the present invention and a method achieving the objects will be clearly understood by referring to the following embodiments which are described with reference to the accompanying drawings. However, it will be apparent to those skilled in the art that various changes and modifications may be made without departing from the scope of the invention as defined in the following claims. The present invention is only defined by the scope of claims in the present specification. Herein, the same reference number is given to the same constituent element throughout the specification although it appears in different drawings.

Hereinafter, preferred embodiments of the present invention will be described in detail with reference to the accompanying drawings.

[A Counterfeit Prevent Paper]

Figure 1:
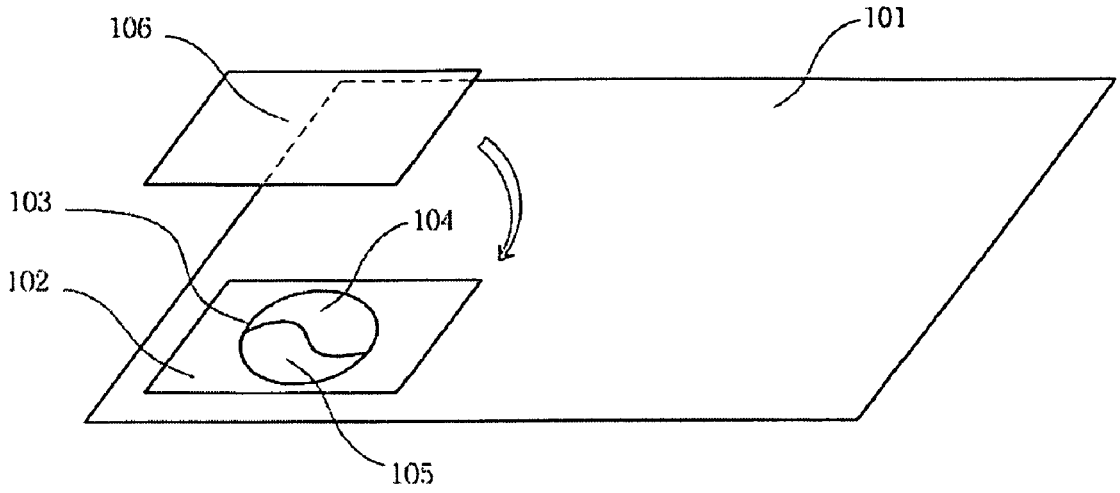
FIG. 1 illustrates a counterfeit prevent paper according to an embodiment of the prevent invention.

FIG. 1 represents a counterfeit prevent paper according to an embodiment of the present invention.

Referring to FIG. 1, the counterfeit prevent paper according to an embodiment of the present invention comprises a paper 101 and a thermopaint layer 103 which is formed on the paper 101 and a color is discolored according to a temperature.

First of all, there is the thermopaint layer 103 which a color is discolored according to a temperature on the paper 101. The thermopaint layer 103 comprises a reversible Poly-di-acetylene layer 104 and an irreversible Poly-di-acetylene layer 105. The thermopaint layer 103, as illustrated in FIG,l, can be manufactured as the shape of great absolute design having an embossment and intaligo. The irreversible Poly-di-acetylene layer 105 can be formed from a design of embossment, and the reversible Poly-di-acetylene layer 104 can be formed from a design of intaligo.

Figure 3:
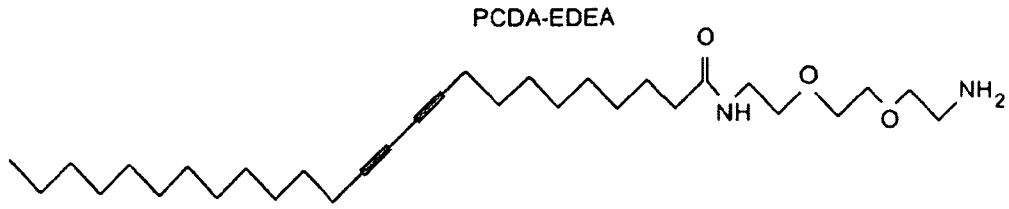
FIGS. 3 and 4 illustrate a chemical formula of material being used for manufacturing Poly-di-acetylene according to an embodiment of the prevent invention.

The reversible Poly-di-acetylene layer 104 can be formed from Poly-vinyl Alcohol and Poly-vinyl Alcohol, which is manufactured by 10,12-pentacosadiynoic acid-2,21-(ethylenedioxy)bis(ethylamine), (PCDA-EDEA). The 10,12-pentacosadiynoic acid-2,2'-(ethylenedioxy)bis(ethylamine) is a monomer which the end part is replaced with a group of Amine A chemical formula of the 10,12-pentacosadiynoic acid-2,2'-(ethylenedioxy)bis(ethylamine) can represent as illustrated in FIG. 3.

The color of the reversible Poly-di-acetylene layer 104 discolors reversibly in a specific temperature of about 30° C. to 80° C. in case that an external heat is applied.

Figure 2:
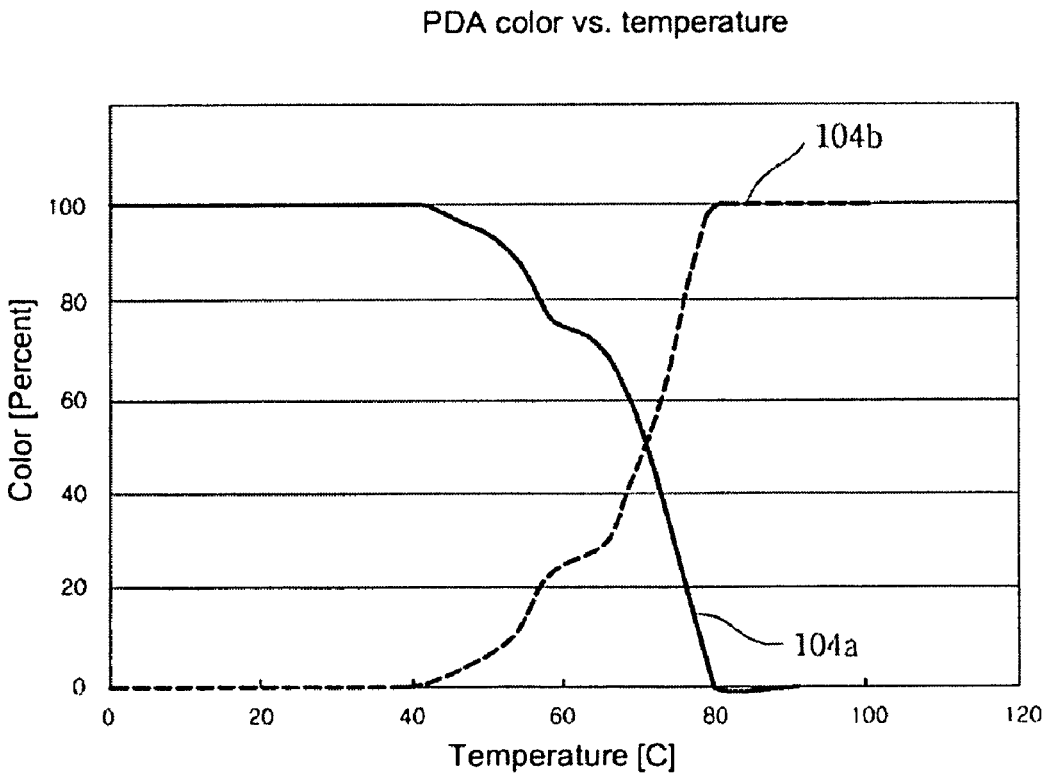
FIG. 2 illustrates a discoloration of Poly-di-acetylene according to an embodiment of the prevent invention.

FIG. 2 is a graph for explaining a discoloration of reversible Poly-di-acetylene according to a temperature change.

It will be explained about the discoloration of reversible Poly-di-acetylene according to the temperature change referring to FIG. 2.

Referring to a graph of FIG. 2, a numerical value of vertical axis means a color ratio of reversible Poly-di-acetylene. As illustrated in FIG. 2, the reversible Poly-di-acetylene 104*a* of a blue color starts a discoloration into a red color from about 30° C. In other words, a decrease of color ratio of blue color means an increase of color ratio of red color. Thereafter, the discoloration of reversible Poly-di-acetylene 104*a* is completed at about 80° C. The color of reversible Poly-di-acetylene 104*a* discolored into red color is preserved constantly over 80° C. The reversible Poly-di-acetylene 104*b* discolored to the red color is discolored again to the blue color according to a decrease of temperature from about 80° C. to 30° C. In other words, a decrease of color ratio of red color means an increase of color ratio of blue color. The reversible Poly-di-acetylene 104*b* discolored to blue color is preserved constantly below about 30° C.

Figure 4:
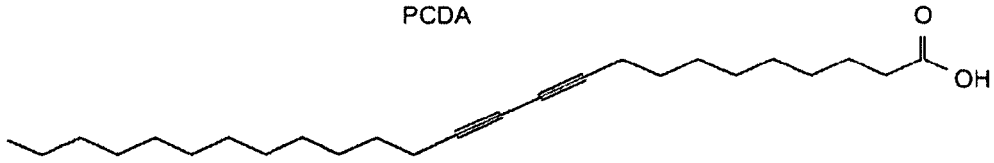

The irreversible Poly-di-acetylene layer 105 can be formed from Poly-vinyl Alcohol and Poly-di-acetylene which is manufactured by 10,12-pentacosadiynoic acid (PCDA). A chemical formula of the 10,12-pentacosadiynoic acid can represent as illustrated in FIG. 4. Unlike reversible Poly-di-acetylene layer 104, the irreversible Poly-di-acetylene layer 105 has a characteristic which a discolored color because of an increase of temperature by an external heat source is constant even if a temperature is decreased by removing of an external heat source. For example, a color of the reversible Poly-di-acetylene having a blue color is discolored to a red color according to an increase of temperature from about 30° C. to 80° C. The irreversible Poly-di-acetylene layer 105 having a red color is not discolored even if a temperature is decreased less than about 30° C.

Accordingly, The reversible Poly-di-acetylene layer 104 that a discoloration of color is reversible and the irreversible Poly-di-acetylene layer 105 that a discolored color is preserved constantly are comparable each other according to a change of temperature.

An adhesion layer 102 can be adhered between the paper 101 and a thermopaint layer 103. The adhesion layer 102 can be adhered on the paper 101 by using adhesives including a Polysiloxane which a fixed power and thermal resistance are great. The adhesion layer 102 can be formed by including one out of Polyester, Nylon and Polyimide. Hereby, a heat impairment of the thermopaint layer 103 by heating process being accompanied with a following process detecting a counterfeit can be minimized by using the adhesion layer 103 being formed of material having a high thermal resistance and the adhesives.

A protection layer 106 can be formed on the thermopaint layer 103. The protection layer 106 can be formed by including one out of colorless and transparent Polyester, Nylon and Polyimide having a high thermal resistance. The thermopaint layer 103 discolored according to a change of temperature by the colorless and transparent protection layer 106 can be visible. Also, it plays a role in protecting the thermopaint layer 103 from an external environment such as a dust and humidity, etc. A heat impairment of the thermopaint layer 103 by a heating contact being accompanied with a process detecting a counterfeit can be minimized by using the protection layer 106 being formed of material having a high thermal resistance and the adhesives

[A Method of Manufacturing a Counterfeit Prevent Paper]

Figure 5:
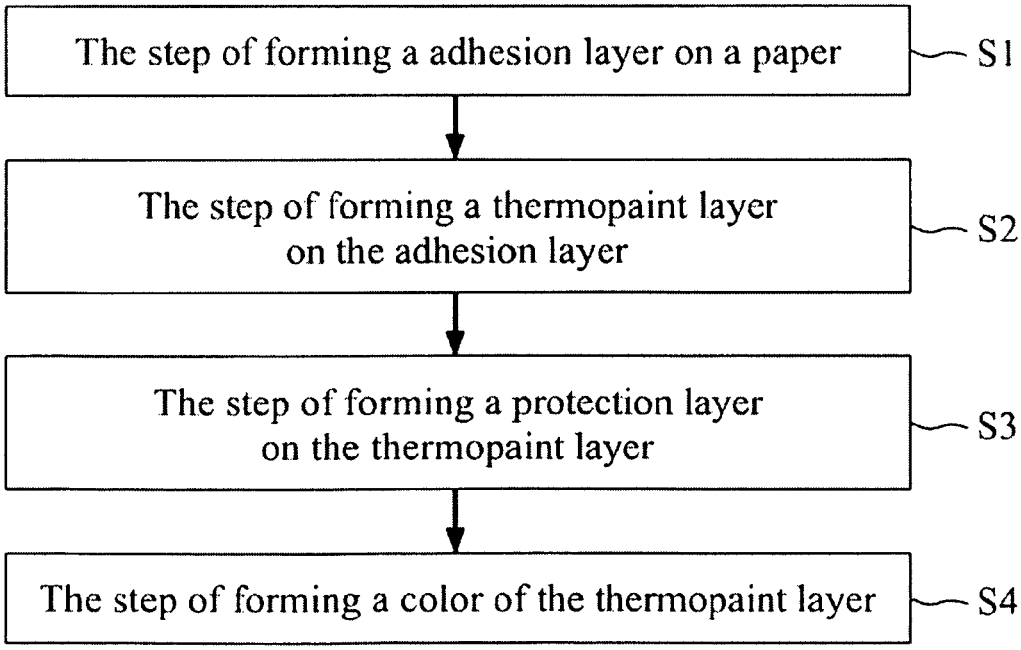
FIG. 5 illustrates a method for manufacturing counterfeit prevent paper according to an embodiment of the prevent invention.

FIG. 5 represents a method of manufacturing a counterfeit prevent paper according to an embodiment of the present invention.

It will be explained about a method of manufacturing a counterfeit prevent paper according to an embodiment of the present invention referring to FIG. 1 and FIG. 5.

Referring to FIG. 1 and FIG. 5, the method of manufacturing a counterfeit prevent paper according to an embodiment of the present invention comprises the step of (S1) forming an adhesion layer 102 on the paper 101 and (S2) forming a thermopaint layer 103 being discolored according to a temperature on the adhesion layer 102.

First of all, the adhesion layer 102 is formed on the paper 101 (S1). The adhesion layer 102 can be formed by including one out of Polyester, Nylon and Polyimide having a high thermal resistance. The adhesion layer 102 can be adhered on the paper 101 by adhesives including Polysiloxane which a fixed power and a thermal resistance are great. Hereby, a heat impairment of the thermopaint layer 103 by heating process being accompanied with a process detecting a counterfeit can be minimized by using the adhesion layer 102 being formed from material having a high thermal resistance and the adhesives.

Thereafter, the thermopaint layer 103 being discolored according to a temperature on the adhesion layer 102 (S2). The thermopaint layer 103 comprises the reversible Poly-di-acetylene layer 104 and the irreversible Poly-di-acetylene layer 105. The reversible Poly-di-acetylene layer 104 can be formed from Poly-vinyl Alcohol (PVA) and Poly-di-acetylene (PDA) which is manufactured by 10,12-pentacosadiynoic acid-2,2'-(ethylenedioxy)bis(ethylamine), (PCDA-EDEA). The 10,12-pentacosadiynoic acid-2,2'-(ethylenedioxy)bis(ethylamine) is a monomer that the end part is replaced with a group of amine. A chemical formula of the 10,12-pentacosadiynoic acid-2,2'-(ethylenedioxy)bis(ethylamine) can represent as illustrated in FIG. 3.

It will be explained about a manufacturing method of the reversible Poly-di-acetylene layer 104.

First of all, an uniformed mixing solution is formed by mixing a Poly-vinyl Alcohol solution and a Poly-di-acetylene solution manufactured by 10,12-pentacosadiynoic acid-2,2'-(ethylenedioxy)bis(ethylamine) having a weight ratio of 10% with a volume ratio of 1:1. A color of the mixing solution may be a colorless and transparent color. Thereafter, a predetermined amount of the mixing solution using a spoid is sprayed on the Petri plate. A thickness and area of the reversible Poly-di-acetylene layer 104 can be decided according to a viscosity of the mixing solution being sprayed on the Petri plate. Subsequently, the mixing solution being sprayed on the Petri plate hardens about 48 hours. The reversible Poly-di-acetylene layer 104 having an elasticity and durability through a process of hardening.

As illustrated in FIG. 2, a color of the reversible Poly-di-acetylene discolors reversibly at a specific temperature of about 30° C. to 80° C. in case that an external heat is applied. A numerical value of vertical axis means a color ratio of the reversible Poly-di-acetylene in the graph of FIG. 2. As illustrated in FIG. 2, the reversible Poly-di-acetylene 104*a* of a blue color starts to be discolored into a red color from about 30° C. according to an increase of temperature. In other words, a decrease of color ratio of the blue color means an increase of color ratio of the red color. Thereafter, a discoloration of the reversible Poly-di-acetylene 104*a* is completed at about 80° C. The reversible Poly-di-acetylene 104*a* discolored to red color is preserved constantly over about 80° C. The reversible Poly-di-acetylene 104*b* discolored to the red color is discolored again to the blue color according to a decrease of temperature from about 80° C. to 30° C. In other words, a decrease of color ratio of red color means an increase of color ratio of blue color. The reversible Poly-di-acetylene 104*b* discolored to blue color is preserved constantly below about 30° C.

The irreversible Poly-di-acetylene layer 105 is formed from Poly-vinyl Alcohol and Poly-di-acetylene which is manufactured by 10,12-pentacosadiynoic acid, (PCDA). A chemical formula of the 10,12-pentacosadiynoic acid can represent as illustrated in FIG. 4.

It will be explained about a method of manufacturing the irreversible Poly-di-acetylene layer 105.

First of all, an uniformed mixing solution is formed by mixing a Poly-vinyl Alcohol solution and a Poly-di-acetylene solution manufactured by 10,12-pentacosadiynoic acid-2,2'-(ethylenedioxy)bis(ethylamine) having a weight ratio of 10% with a volume ratio of 1:1. A color of the mixing solution may be a transparent color. Thereafter, a predetermined amount of the mixing solution using a spoid is sprayed on the Petri plate. A thickness and area of the irreversible Poly-di-acetylene layer 105 can be decided according to a viscosity of the mixing solution being sprayed on the Petri plate at normal temperature. Thereafter, the mixing solution being sprayed on the Petri plate hardens about 48 hours. The irreversible Poly-di-acetylene layer 105 having an elasticity and durability through a process of hardening. Unlike reversible Poly-di-acetylene layer 105, the irreversible Poly-di-acetylene layer 105 has a characteristic which a discolored color because of an increase of temperature by an external heat source is preserved even if a temperature is decreased by removing of an external heat source. For example, a color of the reversible Poly-di-acetylene having a blue color is discolored to a red color according to an increase of temperature from about 30° C. to 80° C. The irreversible Poly-di-acetylene layer 105 having the red color is not discolored even if the temperature is decreased less than about 30° C. Accordingly, The reversible Poly-di-acetylene layer 104 that a discoloration of color is reversible and the irreversible Poly-di-acetylene layer 105 that a discolored color is preserved constantly is comparable each other according to the change of temperature.

Thereafter, a protection layer 106 is formed on the thermopaint layer 103 (S3). The protection layer 106 can be formed by including one out of a colorless and transparent Polyester, Nylon and Polyimide having a high thermal resistance. The thermopaint layer 103 being discolored because of a change of temperature by the colorless and transparent protection layer 106 is visible. Also, the protection layer 106 plays a role in protecting the thermopaint layer 103 from an external environment such as a dust and humidity. Also, as the protection layer 106 is formed from an element having a high thermal resistance, a heat impairment of the thermopaint layer 103 by heating process being accompanied with a following process detecting forgery can be minimized Thereafter, a color of the thermopaint layer 103 is formed selectively (S4) At first, a method of forming the color of the thermopaint layer 103 irradiates an ultraviolet lay on the protection layer 106 and causes a polymerization in the reversible Poly-di-acetylene layer 104 and the irreversible Poly-di-acetylene layer 105. By controlling a exposing amount of the ultraviolet irradiated on the protection layer 106. For example, if the ultraviolet having a exposing amount of about 0.5 $mW/cm^2$ on the protection layer 106 is irradiated for three minutes, the reversible Poly-di-acetylene layer 104 and the irreversible Poly-di-acetylene layer 105 changed from a transparent state to Prussian blue. Also, the reversible Poly-di-acetylene layer 104 and the irreversible Poly-di-acetylene layer 105 having a bluish green color, light blue and light purple color, etc. (that is, a color between Prussian blue and transparent) can be formed by controlling a exposing amount and an irradiating time of the ultraviolet.

The counterfeit prevent paper according to the present invention can discriminate easily with an unaided eye by using Poly-di-acetylene discolored reversibly at the specific temperature. Also, a function for preventing a counterfeit is not copied by a counterfeit device, thus the counterfeit prevent paper according to the present invention can improve a reliability of various official document and several certificates, etc.

The invention being thus described may be varied in many ways. Such variations are not to be regarded as a departure from the spirit and scope of the invention and all such modifications as would be obvious to one skilled in the art are intended to be included within the scope of the following claims.

What is claimed is:

1. A counterfeit prevention paper comprising:

a paper; and a thermopaint layer being formed on the paper and discolored according to a temperature, wherein the thermopaint layer comprises a reversible Poly-di-acetylene layer and an irreversible Poly-di-acetylene layer.

2. The counterfeit prevention paper of claim 1, further comprising an adhesion layer being formed between the paper and the thermopaint layer.

3. The counterfeit prevention paper of claim 2, wherein the adhesion layer comprises one out of Polyester, Nylon and Polyimide.

4. The counterfeit prevention paper of claim 2, wherein the adhesion layer and the paper are adhered by adhesives including Polysiloxane.

5. The counterfeit prevention paper of claim 1, further comprising a protection layer being formed on the thermopaint layer.

6. The counterfeit prevention paper of claim 3, wherein the protection layer comprises one out of colorless and transparent Polyester, Nylon and Polyimide.

7. The counterfeit prevention paper of claim 1, wherein the reversible Poly-di-acetylene layer is formed from Poly-vinyl Alcohol and Poly-di-acetylene, and the Poly-di-acetylene is manufactured by 10,12-pentacosadiynoic acid-2,2'-(ethylenedioxy)bis(ethylamine).

8. The counterfeit prevention paper of claim 1, wherein the irreversible Poly-di-acetylene layer is formed from Poly-vinyl Alcohol and Poly-di-acetylene, and the Poly-di-acetylene is manufactured by 10,12-pentacosadiynoic acid.

9. The counterfeit prevention paper of claim 1, wherein the reversible Poly-di-acetylene layer is discolored reversibly at 30° C. to 80° C.

10. A method of manufacturing a counterfeit prevention paper comprising the steps of:

forming an adhesion layer on a paper; and forming a thermopaint layer being discolored according to a temperature on the adhesion layer, wherein the thermopaint layer comprises a reversible Poly-di-acetylene layer and an irreversible Poly-di-acetylene layer.

11. The method of manufacturing a counterfeit prevention paper of claim 10, further comprising the step of forming a protection layer on the thermopaint layer.

12. The method of manufacturing a counterfeit prevention paper of claim 11, wherein the protection layer comprises one out of colorless and transparent Polyester, Nylon and Polyimide.

13. The method of manufacturing a counterfeit prevention paper of claim 10, wherein the adhesion layer is formed from one out of Polyester, Nylon and Polyimide.

14. The method of manufacturing a counterfeit prevention paper of claim 10, wherein the reversible Poly-di-acetylene layer is formed from Poly-vinyl Alcohol and Poly-di-acetylene, and the Poly-di-acetylene is manufactured by 10,12-pentacosadiynoic acid-2,2'-(ethylenedioxy)bis(ethylamine).

15. The method of manufacturing a counterfeit prevention paper of claim 10, wherein the reversible Poly-di-acetylene layer is discolored reversibly at 30° C. to 80° C.

16. The method of manufacturing a counterfeit prevention paper of claim 10, wherein the irreversible Poly-di-acetylene layer is formed from Poly-vinyl Alcohol and Poly-di-acetylene, and the Poly-di-acetylene is manufactured by 10,12-pentacosadiynoic acid.

17. The method of manufacturing a counterfeit prevention paper of claim 10, wherein the adhesion layer and the paper are adhered by adhesives including Polysiloxane.

* * * * *